United States Patent [19]

Heikel et al.

[11] 4,214,971

[45] * Jul. 29, 1980

[54] ELECTRODE COATING PROCESS

[75] Inventors: Henrik R. Heikel; James J. Leddy, both of Midland, Mich.

[73] Assignee: The Dow Chemical Company, Midland, Mich.

[ * ] Notice: The portion of the term of this patent subsequent to Sep. 5, 1995, has been disclaimed.

[21] Appl. No.: 933,303

[22] Filed: Aug. 14, 1978

Related U.S. Application Data

[63] Continuation-in-part of Ser. No. 787,418, Apr. 14, 1977, Pat. No. 4,112,140.

[51] Int. Cl.[2] ..... B05D 5/12

[52] U.S. Cl. ..... 204/290 F; 427/126.3; 427/126.5; 427/343; 428/469; 428/472

[58] Field of Search ..... 427/126, 380; 204/290 F

[56] References Cited

U.S. PATENT DOCUMENTS

| | | | |
|---|---|---|---|
| 3,632,498 | 1/1972 | Beer | 204/290 F |
| 3,711,385 | 1/1973 | Beer | 427/126 |
| 3,773,554 | 11/1973 | Scrutton et al. | 427/126 |
| 3,776,834 | 12/1973 | O'Leary | 204/290 F |
| 3,869,312 | 3/1975 | Moss et al. | 204/290 F |
| 4,107,025 | 8/1978 | Loutfy et al. | 204/290 F |
| 4,112,140 | 9/1978 | Heikel | 427/126 |

*Primary Examiner*—Michael F. Esposito
*Assistant Examiner*—Richard Bueker
*Attorney, Agent, or Firm*—Robert W. Selby

[57] ABSTRACT

A method to produce an electrode by coating at least a portion of a valve metal substrate sequentially with first and second liquid solutions containing different proportions of dissolved ruthenium and valve metal values; the second solution having a greater valve metal to ruthenium weight ratio than the first solution. At least a portion of the substrate is contacted with a first liquid solution containing from about 0.25 to about 50 milligrams per milliliter ruthenium, and the valve metal in an amount of from about 0.06 to about 50 milligrams per milliliter, of the solution. The weight ratio of the valve metal to ruthenium in the first solution is from about 1:4 to about 2:1. The so-contacted surface is heated to oxidize the deposited ruthenium and valve metal values. Thereafter at least the oxidized surface is contacted with a second solution containing dissolved valve metal and ruthenium values in a weight ratio of from about 20:1 to about 2:1 and heated to oxidize the deposited metal values.

39 Claims, No Drawings

ELECTRODE COATING PROCESS

CROSS REFERENCE TO RELATED APPLICATION

This is a continuation-in-part of an application bearing Ser. No. 787,418, filed Apr. 14, 1977, now U.S. Pat. No. 4,112,140, issued Sept. 5, 1978.

BACKGROUND OF THE INVENTION

This invention pertains to electrodes and more in particular to an improved method of coating an electrode with a ruthenium compound.

Metallic electrodes of various metals, commonly known as valve or film-forming metals, such as tantalum, titanium and tungsten, have been employed as electrodes, that is, anodes or cathodes, in electrolytic processes, for example, producing chlorates, hypochlorites or chlorine and alkali metal hydroxide from aqueous sodium chloride containing brines. U.S. Pat. Nos. 3,632,498; 3,711,385 and 3,776,834 describe coating such valve metals with activating oxides to improve the electrode performance over previously available electrodes.

A portion of the electrode activating coating is generally lost during use of the electrode in an electrolytic cell. When the electrode is coated with mixed ruthenium and titanium oxides, the loss of ruthenium during the electrolysis of an aqueous alkali metal chloride solution in U.S. Pat. Nos. 3,632,478 and 3,711,385 is less than 0.1 and 0.5 gram per ton of chlorine produced, respectively. When the oxide coating contains a substantial portion of tin dioxide as in U.S. Pat. No. 3,776,834, the ruthenium wear-rate is alleged to average 0.01 gram per ton of chlorine produced.

In view of the relatively limited supply of ruthenium available, it would be desirable to provide an efficient electrode suitable for use in the electrolysis of an alkali metal chloride which consumes only minor amounts of ruthenium.

SUMMARY OF THE INVENTION

An improved ruthenium-containing, electrode-activating coating can be applied to a valve metal substrate by use of the hereinafter described process. The electrode formed is suitable for use in electrolytic processes, such as the production of gaseous chlorine and an alkali metal hydroxide from an aqueous alkali metal chloride solution or brine in a diaphragm type electrolytic cell, the electrolytic production of sodium chlorate or in anodic or cathodic metal protection systems. The present process consumes only minor quantities of ruthenium in manufacturing electrodes. Moreover, only minor amounts of ruthenium are consumed for each pound of chlorine produced in electrolytic cells with electrodes produced by the hereinafter described process.

The method involves contacting at least a portion of a valve metal substrate sequentially with first and second liquid solutions containing different proportions of dissolved ruthenium and valve metal values; the second solution having a greater valve metal to ruthenium weight ratio than the first solution. At least a surface portion of the substrate is contacted with a first liquid solution containing, as a solute, ruthenium in an amount of from about 0.25 to about 50 milligrams per milliliter (mg/ml) of the solution and a valve metal in an amount of from about 0.06 to about 50 mg/ml of the solution; at least one solvent suitable to dissolve both the ruthenium and valve metal values and a sufficient amount of an acid to maintain the solute in solution. The weight ratio of the valve metal to ruthenium in the first solution is from about 1:4 to about 2:1.

At least a portion of the surface contacted with the first solution is heated sufficiently to form an adherent coating containing oxides of ruthenium and the valve metal on the substrate.

At least a portion of the surface coated with the oxides of ruthenium and the valve metal is contacted with a second liquid solution containing, as a solute, ruthenium in an amount of from about 0.25 to about 25 mg/ml of the second solution, a valve metal in an amount of from about 1 to about 100 mg/ml of the second solution; at least one solvent suitable to dissolve both the ruthenium and valve metal values; and a sufficient amount of an acid to maintain the solute in solution. The weight ratio of the valve metal to ruthenium in the second solution is from about 20:1 to about 2:1.

At least the substrate surface portion contacted with the second solution is heated sufficiently to form an adherent overcoating containing the oxides of ruthenium and the valve metal on the substrate.

DESCRIPTION OF THE PREFERRED EMBODIMENTS

In a preferred embodiment of the invention, a valve metal substrate, such as lead, molybdenum, niobium, tantalum, tungsten, vanadium, zirconium and more preferably titanium, suitable for use as an electrode is suitably cleaned to remove, for example, grease or oil, from the surface of the substrate to be coated with the activating oxides. The electrode surfaces are cleaned sufficiently to expose the metallic substrate and a thin oxide layer normally present on such metal. Most preferably, for improved adherence of the coating on the substrate, substantially only the surface of the valve metal coated with an adherent film of the oxide of such valve metal is present after cleaning.

Cleaning the valve metal surface is carried out by means well-known to those skilled in the art of metal cleaning. For example, organic materials are readily removed from metal surfaces by total immersion in a solvent bath or by vapor degreasing.

A coating with superior adherence is achieved by providing a roughened, irregular surface by, for example, contacting the cleaned surface with a mechanical means to disrupt such surface. For example, an alumina abrasive "grit blast" has been found to be satisfactory to provide the desired roughened surface. Alumina particles with a U.S. Standard Mesh size of from about 30 to about 50 are satisfactory for such "grit blast". Abrasive brushes, papers and wheels are further examples of suitable means to provide a valve metal surface suitable for being coated with the oxides of the valve metal and ruthenium. It is preferred that the particular means employed for roughening be selected so as to minimize contamination of the cleaned surface with, for example, loose particles of metal or the abrasive used for the roughening operation.

When the valve metal surface is not contaminated with a large amount of organic materials, the solvent cleaning step can be eliminated and, optionally, only the preferred mechanical means used to both clean and roughen the surface.

After cleaning and, optionally, roughening the surface, a first liquid solution is applied to at least a portion of such surface by a suitable well-known means such as brushing, spraying, flow coating (i.e. pouring the solution over the surface to be coated), or immersing that portion of the substrate to be coated in the solution.

The hereinafter description will refer to the most preferred embodiment using titanium metal as the substrate and solubilized titanium in the first and second solutions; however, it is to be understood that the invention is not to be limited to this particular valve metal.

The first solution preferably consists essentially of ruthenium in an amount of from about 5 to about 25 mg/ml of solution and titanium in an amount of from about 5 to about 25 mg/ml of solution. To further improve the abrasion resistance or durability of the oxide coating, the ratio of titanium to ruthenium preferably is from about 2:1 to about 1:2 and more preferably from about 2:1 to about 1:1. The acid concentration of the first solution is from about 0.1 to about 1 normal, and preferably from about 0.5 to about 0.7 normal. The balance of the first solution includes a solvent such as isopropanol, n-butanol, propanol, ethanol and any cations associated with the ruthenium and titanium present in the solution.

The surface to which the first solution was applied is preferably dried at a temperature below the boiling temperature of the first solution to remove the volatile matter, such as the solvent before heating to form the oxides of ruthenium and titanium. Air drying is satisfactory; however, use of a slightly elevated temperature within the range of from about 25° to about 70° C. and, optionally, a reduced pressure will hasten completion of the drying step.

The dried coating is heated at a temperature of from about 300° to about 450° C. in an oxygen-containing atmosphere for a sufficient time to oxidize the ruthenium and titanium on the substrate surface and form the desired adherent oxide layer. Generally maintaining the substrate at the desired temperature for from about 3 to about 10 minutes is adequate; however, longer times can be employed without detracting from the invention.

After the initial heating step at from about 300° to about 450° C., the coated surface is overcoated with ruthenium and titanium using a second liquid solution with a higher titanium to ruthenium weight ratio than in the first solution. The second solution preferably contains ruthenium in an amount from about 2 to about 10 mg/ml of solution, and titanium in an amount from about 20 to about 40 mg/ml of solution. The titanium to ruthenium weight ratio is preferably from about 10:1 to about 2:1. The solvents and acid ranges for the first solution are also suitable for the second solution.

The second solution is applied to the precoated portion of the substrate, optionally dried, and heated as herein described for the first solution.

To obtain a coating with good adherence to the substrate and a low loss of ruthenium during use as an electrode, the coating resulting from the first solution has a thickness of up to about 3 microns, and the overcoating has a thickness of less than about 1.5 microns.

The second and, if desired, subsequent overcoatings applied with the second solution are preferably sufficient to form individual oxide coatings with thicknesses of up to about 1.5 microns. Increased durability of the coated surfaces is achieved by providing a number of overcoatings with individual thicknesses of up to about 0.5 micron.

A sufficient number of overcoatings is applied to obtain a total thickness of ruthenium and titanium oxides of up to about 10 microns and preferably up to about 3 microns. Coatings of greater thicknesses are operable, but are not required to provide an electrode suitable for electrolytic purposes. It has been found that a titanium substrate coated with the first solution and thereafter coated at least once with the second solution, with drying and heating steps between each coating step, in the herein described manner, results in an electrode with an effective amount of ruthenium and titanium oxides in the coating suitable for use as an anode in an electrolytic cell for producing chlorine from a sodium chlorine containing brine. The coating contains sufficient ruthenium and titanium oxides to permit sufficient electric current flow between the electrodes to achieve the desired electrolysis or corrosion prevention.

Ruthenium and valve metal values can be dissolved in the solvent most readily when such values are mixed with the solvent as compounds of ruthenium and the valve metal. Ruthenium compounds thermally decomposable to a ruthenium oxide in air and/or oxygen, soluble to the extent of at least about 0.25 milligram of ruthenium per milliliter of solution, and stable in the selected solvent are satisfatory. Such ruthenium compounds are, for example, selected from at least one of the following: $RuCl_3.3H_2O$, $Ru(NH_3)_6Cl_3$; $RuCl_3.7NH_3$ and $RuNO(NO_3)_3.3H_2O$.

Compounds of valve metals thermally decomposable to a valve metal oxide in air and/or oxygen, soluble to the extent of at least about 0.06 milligram of the valve metal per milliliter of the first solution, and stable in the solvent, are satisfactory for the first solution; for the second solution, the valve metal compounds should be soluble to the extent of at least about 1 milligram of the valve metal per milliliter of the second solution. For example, when the valve metal is titanium, such compounds are selected from at least one of the following compounds and/or hydrates thereof.

titanium trichloride, titanium tribromide, titanium trifluoride, tetra-isopropyltitanate, tetrakis(2-ethylhexyl)-titanate, tetrastearyltitanate and tetrabutyltitanate and preferably tetra-isopropyltitanite [$Ti(OC_3H_7)_4$], tetrakis (2-ethylhexyl)titanite [$Ti(OC_3H_{17})_4$], tetrastearyltitanite [$Ti(OC_{18}H_{37})_4$] and tetrabutyltitanite [$Ti(OC_4H_9)_4$]. Examples of other suitable valve metal compounds are penta-ethyl-tantalate [$Ta(OC_2H_5)_5$], vanadylacetylacetonate [$VO(C_5H_7O_2)_2$], lead naphthanate and/or hydrates thereof.

Hydrochloric acid has been found to be suitable for use in the herein described solutions. Other acids which will assist in dissolving the selected ruthenium and valve metal compounds into the solution and minimize the formation of, or precipitation of, the oxides of ruthenium and the valve metal within the solution itself are satisfactory. Such acids are, for example, nitric, sulfuric and trichloroacetic.

The following examples will further illustrate the invention.

EXAMPLE 1

An electrode useful as an anode in an electrolytic cell for producing chlorine and sodium hydroxide from a sodium chloride brine was coated with adherent layers of ruthenium and titanium oxides in the following manner.

A first or primer coating solution with ruthenium and titanium concentrations of 6.4 mg/ml of solution was prepared by mixing together 4.40 grams $RuCl_3.3H_2O$, 2.90 grams of concentrated hydrochloric acid (HCl), 200.00 grams of isopropanol and 10.20 grams of tetraisopropyltitanate (TPT). This solution had a density of 0.81 gram per milliliter. The weight ratio of titanium to ruthenium in the solution was about 1 to 1.

A second or overcoating solution was prepared by mixing together 1.38 grams of $RuCl_3.3H_2O$, 3.20 grams of concentrated hydrochloric acid, 66.50 grams of isopropanol and 13.50 grams of TPT. This solution contained ruthenium and titanium in amounts of 5.3 and 22.7 mg/ml of solution, respectively, and had a density of 0.84 gram per milliliter. The ratio of titanium to ruthenium in the second solution was about 4.32 to 1.

A 3 inch by 5 inch by 1/16 inch thick piece of titanium sheet meeting the requirements of ASTM standard B-265-72 was cleaned by grit blasting with 46 mesh (U.S. Standard Sieve Series) alumina ($Al_2O_3$) grit using apparatus with a 7/16 inch diameter grit orifice and a 3/16 inch diameter air orifice. The grit orifice was maintained at a distance of 4 inches from the titanium sheet; air pressure was 70 pounds per square inch at the entrance to the blasting apparatus and the blasting rate was 15 to 20 square inches of titanium surface per minute. The grit blasted surfaces were determined, from photomicrographs, to have depressions therein averaging about 2 microns in depth. The depth of such depressions is, though, not critical.

A sufficient amount of the first coating solution was poured over the cleaned titanium surfaces to wet such surfaces. Excess solution was drained from the wetted surfaces before drying such surfaces at room temperature (about 21° C.) for 15 minutes. The ruthenium and titanium in dried coating was oxidized by heating the dried titanium sheet in air in a muffle furnace for 10 minutes at 400° C. After cooling, the coated surface was determined to contain about 20 micrograms of ruthenium per square centimeter ($\mu g$ $Ru/cm^2$) of coating.

A sufficient amount of the second solution was poured over the oxide coated surfaces to wet such surfaces. The wetted surfaces were sequentially drained of excess solution, air dried at room temperature for 15 minutes and oxidized by heating in air at 400° C. for 10 minutes in a muffle furnace. A total of six overcoatings were applied to the titanium substrate using the second solution and the above-described procedure. The ruthenium content of the final coating was determined by standard X-ray fluorescence techniques to be 175 $\mu g$ $Ru/cm^2$.

The titanium electrode with an adherent coating of the oxides of ruthenium and titanium was tested as an anode in a laboratory electrolytic cell with a glass body to produce gaseous chlorine from an acidic, aqueous solution containing about 300 grams per liter sodium chloride. The anode, with an area of about 12½ square inches, was suitably spaced apart from a steel screen cathode by a diaphragm drawn from an asbestos slurry. The cell was operated for 170 days at an anode current density of 0.5 amp per square inch and a voltage of 2.79. The sodium hydroxide concentration in the catholyte was about 100 grams per liter. After operating for the 170 day period, it was determined that 40 $\mu g$ $Ru/cm^2$ of anode surface had been consumed. This ruthenium loss is equivalent to 0.084 gram of ruthenium per ton of chlorine produced.

EXAMPLE 2

A 3 inch by 4 inch by 1/16 inch section of titanium sheet was cleaned and coated with ruthenium and titanium oxides substantially as in Example 1. The first solution contained 1.4 weight percent concentrated hydrochloric acid, titanium (added as TPT) in an amount of 7.5 ) mg/ml of solution, ruthenium (added as $RuCl_3.3H_2O$) in an amount of 23 mg/ml of solution and the balance being the solvent, isopropanol. The second solution, used to obtain each of six overcoatings, contained titanium (added as TPT) and ruthenium (added as $RuCl_3.3H_2O$) in amounts of 23 and 5 mg/ml of solution, respectively; 3.8 weight percent concentrated hydrochloric acid and the balance being isopropanol. Both the first and second solutions also contained minor amounts of impurities normally associated with the above components of such solutions. The final oxide coating contained a total of 205 $\mu g$ $Ru/cm^2$.

The coated electrode was used as an anode in an electrolytic cell substantially as in Example 1, save for the voltage, which was 2.74. The chlorine efficiency of the cell was 98.7 percent. The gaseous chlorine evolved from this cell contained only 1.10 volume percent oxygen.

EXAMPLE 3

An electrode was produced and operated as an anode in an electrolytic cell substantially as in Example 2. The first coating solution was substantially the same as in Example 2 except that ruthenium and titanium were present in amounts of 6.4 mg/ml of solution. Six overcoating oxide layers were applied to the oxidized first coating layer with the second solution of Example 2. The final oxide coating on the electrode was determined to contain 180 $\mu g$ $Ru/cm^2$.

The efficiency of the chlorine cell operating substantially as in Example 2 with the comparative electrode as an anode was only 97.1 percent. Gaseous chlorine produced was contaminated with 2.47 volume percent oxygen.

EXAMPLE 4

A 3½ inch by 4 inch by 1/16 inch thick portion of flat, ASTM B-265-72 grade titanium sheet was cleaned to remove heavy oxide scale and to provide a roughened surface, with what is believed to be about a molecular layer of titanium dioxide thereon, by grit blasting with 46 mesh alumina. The cleaned surface was contacted with a first solution and thereafter with a second solution substantially as described for Example 1. The first solution contained ruthenium and titanium in amounts of 1.67 mg/ml of solution, 0.3 weight percent concentrated hydrochloric acid and isopropanol as a solvent. The second solution contained 1.31 and 5.50 mg/ml of ruthenium and titanium, respectively, 1.5 weight percent concentrated hydrochloric acid and isopropanol. The ruthenium and titanium in both the first and second solutions was provided by $RuCl_3.3H_2O$ and TPT as in Example 1.

After applying the first solution to the titanium sheet and air drying, the solution wetted surface was heated to a temperature of 425° C. for 10 minutes in an oxygen containing atmosphere to oxidize substantially all of the deposited titanium and ruthenium values and form an adherent oxide containing coating on the surface of the titanium. The oxide coating contained 6.0 $\mu g$ $Ru/cm^2$ of coated titanium surface.

The heated titanium was cooled to room temperature and a single oxide overcoating applied to the ruthenium and titanium oxide coated surface as for the first coating by pouring the second solution over the titanium sheet and permitting any excess second solution to drain from the surface. The surface was dried and heated at 425° C. in a manner substantially the same as for the first coating. The ruthenium content of the first and second oxide coatings was a total of 11.6 $\mu$g Ru/cm$^2$ of coated surface.

The so-coated titanium electrode was used as an anode to produce gaseous chlorine and sodium hydroxide in an electrolytic cell, and by a process, substantially as described in Example 1 at a voltage of 2.78. After about 11 months of continuous operation the loss of the oxide coating on the anode was determined to be less than 0.012 gram of ruthenium per ton of chlorine produced.

EXAMPLE 5

A titanium sheet meeting the standards of ASTM B-265-72 was alumina blasted and contacted with first and second solutions substantially as carried out in Example 1, save for the drying temperature which was 60° C. The first solution contained an isopropanol solvent, titanium and ruthenium in amounts of 25 mg/ml of solution and 4.3 weight percent of concentrated hydrochloric acid. The second solution, which was suitably applied to the titanium surface to provide four separate overcoatings of ruthenium and titanium oxides, contained isopropanol, titanium and ruthenium in amounts of 22.7 and 5.25 mg/ml of solution, respectively, and 3.8 weight percent concentrated hydrochloric acid. The ruthenium and titanium values were provided by mixing $RuCl_3.3H_2O$ and TPT with isopropanol and the hydrochloric acid. The total ruthenium content of the final coating was 150 $\mu$g/cm$^2$.

The so-formed electrode with an adherent coating containing substantially only the oxides of ruthenium and titanium was determined to have a half cell anode potential of 1.10 volts. The half cell voltage was determined by means of a potassium chloride salt bridge connected to a standard calomel reference electrode. An orifice to the salt bridge was positioned about one millimeter spaced apart from the anode surface of an electrolytic cell operated substantially as in Example 1.

EXAMPLE 6

A 1/16 inch by 48 inch by 48 inch expanded titanium mesh was degreased by immersing in an inhibited 1,1,1-trichloroethane solvent and thereafter roughened by alumina grit blasting. The cleaned, roughened titanium surface was immersed into a first solution containing 6 mg/ml of ruthenium, 6 mg/ml of titanium, 3.8 weight percent concentrated hydrochloric acid and isopropanol. When the titanium surface had been wetted with such first solution, the titanium mesh was removed from the first solution, air dried at room temperature and heated for 10 minutes at 400° C. in an oxygen containing muffle-type furnace. The heated titanium mesh was removed from the furnace, cooled and coated four separate times with a second solution. Between each application of the second solution, the titanium mesh was dried, heated and cooled substantially as carried out with the first solution. The second solution contained 20 mg/ml of titanium (added as TPT), 5 mg/ml of ruthenium (added as $RuCl_3.3H_2O$); 3.8 weight percent concentrated hydrochloric acid with the balance being isopropanol.

The so-produced electrode with an adherent, abrasion resistant oxide coating was used as an anode in an electrolytic cell with satisfactory results.

EXAMPLES 7 and 8

Two 3 inch by 4 inch by 1/16 inch flat titanium samples meeting ASTM B-265-72 were degreased, alumina grit blasted and coated substantially as described in Example 6, except that the second solution contained 5.25 mg Ru/ml, 22.7 mg Ti/ml, 3.8 weight percent concentrated hydrochloric acid with the balance of the solution being isopropanol. The temperature employed to oxidize the ruthenium and titanium was 300° C. for one sample and 425° C. for the second sample.

The half cell anode potential of each of the coated samples as determined by the procedure set forth for Example 5 and the abrasion resistance of the coatings were determined to be substantially the same.

EXAMPLE 9

A first solution containing 18 mg/ml of ruthenium, 23 mg/ml of titanium, 8 weight percent concentrated nitric acid ($HNO_3$) and n-butanol is prepared by: mixing $Ru(NH_3)_6Cl_3$ with a sufficient amount of nitric acid to wet the $Ru(NH_3)_6Cl_3$, dissolving this mixture in the n-butanol and thereafter dissolving tetrakis(2-ethylhexyl) titanate in the n-butanol solution. A second solution is prepared in substantially the same manner. The second solution, however, contains 5 mg/ml ruthenium, 90 mg/ml titanium, 8 weight percent concentrated nitric acid and n-butanol.

A 10 inch by 20 inch by ¼ inch thick commercially pure titanium-clad magnesium sheet is cleaned by standard vapor degreasing techniques and sprayed with the first solution until substantially the entire surface of the sheet is wetted by the solution. The wet surface is heated at 450° C. for 5 minutes to substantially completely oxidize the ruthenium and titanium values deposited onto the surface. In substantially the same manner, three separate oxide overcoatings are applied to the surface with the second solution. The thickness of the total oxide layer is about 2.1 microns.

The coated electrode is used in a diaphragm cell substantially as in Example 1.

EXAMPLE 10

A 2 inch diameter by 20 inch long tantalum rod is coated with oxidized ruthenium and tantalum as in Example 9, except that the first solution contains 8 mg/ml tantalum, 10 mg/ml of ruthenium, sufficient concentrated nitric acid to provide a normality of 0.7 and ethanol; and the second solution contains ethanol, 24 mg/ml tantalum, 3 mg/ml ruthenium, and sufficient nitric acid to provide a normality of 0.4. The tantalum and ruthenium in the first and second solutions are added as penta-ethyl-tantalate and $RuNO(NO_3)_3.3H_2O$.

The oxide coated tantalum rod is satisfactory for use as an electrode in a cathodic protection system.

EXAMPLE 11

A 3 inch by 2 inch by 1/16 inch thick portion of commercially pure tantalum sheet is coated once with a first solution and once with a second solution. The sheet is first degreased by immersing in carbon tetrachloride and alumina grit blasting as in Example 1. After the first solution is brushed onto the tantalum surface, the wet layer of solution is air dried at 45° C. and heated to 375° C. for 10 minutes to oxdize the ruthenium and tantalum values. The overcoating is applied with the second solution in substantially the same manner as for the first solution except that the oxidizing temperature is 400° C.

The composition of the first solution is: 6 mg/ml tantalum (added as penta-ethyl-tantalate), 3 mg/ml ruthenium (added as $RuCl_3.3H_2O$), sufficient concentrated sulfuric acid ($H_2SO_4$) to provide an acid normality of 0.5 and propanol. The composition of the second solution is: 20 mg/ml of tantalum, 2 mg/ml of ruthenium, sufficient hydrochloric acid to provide an acid normality of 0.5 and ethanol.

The coating containing oxidized tantalum and ruthenium is less than 1.5 microns thick and is suitable as an anode in an electrolytic diaphragm cell to produce chlorine.

EXAMPLE 12

Except as noted below, an oxide coating is applied to a titanium sheet substantially as in Example 1. The first or primer solution contains 0.27 mg/ml ruthenium and sufficient titanium to provide a titanium to ruthenium weight ratio of 1:3.2. The sheet is flow coated with the first solution by inclining the titanium sheet and causing the solution to flow downwardly across the planar surfaces of the sheet from, for example, edge A toward edge B. Following such solution coating, the sheet is air dried and then heated at 425° C. in air for 10 minutes to oxidize the ruthenium and titanium values. To achieve a more uniform oxide layer on the titanium sheet, the sheet is again flow coated with the first solution by inclining the sheet in a generally opposite direction to that used in the earlier coating step, and causing the first solution to flow from the edge B toward edge A. Drying and heating is carried out as done previously. The total thickness of the oxide layer applied by use of the first solution is about 62 Angstroms. Additional oxide layers can be applied using the first solution and are within the scope of the invention, but such additional layers are generally unnecessary for satisfactory electrode performance.

The sheet coated with a substantially uniform oxide layer by means of the first solution and subsequent heating, is now overcoated twice using a second solution. The methods used for heating and applying the first and second solutions are substantially the same. The second solution contains 0.5 mg/ml ruthenium and 2 mg/ml titanium. The titanium sheet so-coated with an oxide of ruthenium and titanium is suitable as an anode in an electrolytic diaphragm cell for electrolyzing an aqueous sodium chloride brine to form chlorine and sodium hydroxide.

What is claimed is:

1. A method to produce an electrode comprising sequentially:

(a) contacting at least a portion of a valve metal substrate with a first solution containing, as a solute, ruthenium in an amount of from about 0.25 to about 50 milligrams per milliliter of the first solution and a valve metal in an amount of from about 0.06 to about 50 milligrams per milliliter of the first solution, the weight ratio of the valve metal to ruthenium being about 1:4 to about 2:1; at least one solvent suitable to dissolve the ruthenium and valve metal values; and a sufficient amount of an acid to maintain the solute in solution;

(b) heating at least a portion of the contacted surface sufficiently to form a coating containing oxides of ruthenium and the valve metal on the substrate;

(c) contacting at least a portion of the oxide coated surface with a second solution containing, as a solute, ruthenium in an amount of from about 0.25 to about 25 milligrams per milliliter of the second solution and a valve metal in an amount of from about 1 to about 100 milligrams per milliliter of the second solution, the weight ratio of the valve metal to ruthenium being from about 20:1 to about 2:1 and greater than the valve metal to ruthenium ratio of the first solution; at least one solvent suitable to dissolve the ruthenium and valve metal values; and a sufficient amount of an acid to maintain the solute in solution;

(d) heating at least a portion of the contacted surface sufficiently to form a coating containing the oxides of ruthenium and the valve metal on the substrate.

2. The method of claim 1 wherein the valve metal is selected from the group consisting of lead, molybdenum, niobium, tantalum, titanium, tungsten, vanadium and zirconium.

3. The method of claim 1 wherein the valve metal is titanium.

4. The method of claim 3 wherein the titanium present in the first solution is provided by a compound of titanium characterized as being thermally decomposable to an oxide of titanium in the presence of oxygen and soluble to the extent of at least about 0.06 milligram of titanium per milliliter of solution.

5. The method of claim 3 wherein the titanium present in the second solution is provided by a compound of titanium characterized as being thermally decomposable to an oxide of titanium in the presence of oxygen and soluble to the extent of at least about 1 milligram of titanium per milliliter of solution.

6. The method of claim 1 wherein the valve metal present in the first and second solutions is provided by a compound selected from at least one member of the group consisting of titanium tetrachloride, titanium tetrabromide, titanium tetrafluoride, tetra-isopropyltitanate, tetrakis(2-ethylhexyl)titanate, tetrastearyltitanate, tetrabutyl titanate, penta-ethyl-tantalate, vanadylacetylacetomate lead napthanate and hydrates of such compounds.

7. The method of claim 6 wherein the compound contains titanium.

8. The method of claim 7 wherein the compound is a titanate.

9. The method of claim 7 wherein the compound is tetra-isopropyltitanate, tetrakis(2-ethylhexyl)titanate, tetrastearyltitanate, tetrabutyltitanate and hydrates of such compounds.

10. The method of claim 1 wherein the ruthenium present in the first and second solutions is provided by a compound of ruthenium characterized as being thermally decomposable to an oxide of ruthenium in the presence of oxygen and soluble to the extent of at least about 0.25 milligram per milliliter of solution.

11. The method of claim 1 wherein steps (a) and (b) are repeated to apply at least two oxide layers with the first solution.

12. The methods of claims 1 or 11 wherein steps (c) and (d) are repeated to apply at least two oxide layers with the second solution.

13. The method of claim 12 wherein the first solution included ruthenium in an amount of from about 5 to about 25 milligrams per milliliter of solution and titanium in an amount of from about 5 to about 25 milligrams per milliliter of solution.

14. The method of claim 13 wherein the weight ratio of titanium to ruthenium in the first solution is from about 2:1 to about 1:2.

15. The method of claim 13 wherein the weight ratio of titanium to ruthenium in the first solution is from about 2:1 to about 1:1.

16. The method of claim 3 wherein the weight ratio of titanium to ruthenium in the first solution is from about 2:1 to about 1:2.

17. The method of claim 3 wherein the weight ratio of titanium to ruthenium in the first solution is from about 2:1 to about 1:1.

18. The method of claim 12 wherein the second solution includes ruthenium in an amount of from about 2 to about 10 milligrams per milliliter of solution and titanium in an amount of from about 20 to about 40 milligrams per milliliter of solution.

19. The method of claim 18 wherein the weight ratio of titanium to ruthenium in the second solution is from about 10:1 to about 2:1.

20. The method of claim 3 wherein the weight ratio of titanium to ruthenium in the second solution is from about 10:1 to about 2:1.

21. The method of claim 1 wherein the heating steps (b) and (d) are carried out within the temperature range of from about 300° to about 450° C.

22. The method of claim 3 wherein the heating steps (b) and (d) are carried out within the temperature range of from about 300° to about 450° C.

23. The method of claim 1 including the steps of drying the contacted substrate before the heating steps (b) and (d).

24. The method of claim 3 including the steps of drying the contacted substrate before the heating steps (b) and (d).

25. A method to produce an electrode comprising sequentially:

(a) contacting at least a portion of a titanium substrate with a first solution consisting essentially of dissolved ruthenium in an amount of from about 0.25 to about 50 milligrams per milliliter of the first solution, dissolved titanium in an amount of from about 0.06 to about 50 milligrams per milliliter of the first solution, at least one solvent suitable to dissolve the ruthenium and titanium values, and a sufficient amount of an acid to maintain the ruthenium and titanium in solution; the ruthenium and titanium being provided by compounds thermally decomposable to ruthenium and titanium oxides in the presence of oxygen and soluble to the extent of at least about 0.25 milligram ruthenium and 0.06 milligram titanium per milliliter of solution; the weight ratio of titanium to ruthenium in the first solution being about 1:4 to about 2:1;

(b) drying at least a portion of the contacted substrate;

(c) heating at least a portion of the contacted substrate sufficiently to form a coating containing oxides of ruthenium and titanium on the substrate;

(d) contacting at least a portion of the oxide coating with a second solution consisting essentially of dissolved ruthenium in an amount of from about 0.25 to about 25 milligrams per milliliter of the second solution, dissolved titanium in an amount of from about 1 to about 100 milligrams per milliliter of the second solution, at least one solvent suitable to dissolve the ruthenium and titanium values, and a sufficient amount of an acid to maintain the ruthenium in solution; the ruthenium and titanium being provided by compounds thermally decomposable to ruthenium and titanium oxides in the presence of oxygen and soluble to the extent of at least about 0.25 milligram ruthenium and 1 milligram titanium per milliliter of the second solution; the weight ratio of titanium to ruthenium in the second solution being from about 20:1 to about 2:1 and greater than the titanium to ruthenium weight ratio of the first solution;

(e) drying at least a portion of the contacted substrate;

(f) heating at least a portion of the contacted substrate sufficiently to form a coating containing oxides of ruthenium and titanium on the substrate.

26. The method of claim 25 wherein the titanium compound in the first and second solutions is selected from at least one member of the group consisting of titanium-isopropyl-titanate, tetrakis(2-ethylhexyl)titanate, tetrastearyl-titanate and tetrabutyl titanate.

27. The method of claim 25 wherein steps (a), (b) and (c) are repeated to apply at least two oxide layers with the first solution.

28. The methods of claims 25 or 27 wherein steps (d), (e) and (f) are repeated to apply at least two oxide layers with the second solution.

29. The method of claim 28 wherein the first solution includes ruthenium in an amount of from about 5 to about 25 milligrams per milliliter of solution and titanium in an amount of from about 5 to about 25 milligrams per milliliter of solution.

30. The method of claim 29 wherein the weight ratio of titanium to ruthenium in the first solution is from about 2:1 to about 1:2.

31. The method of claim 28 wherein the weight ratio of titanium to ruthenium in the first solution is from about 2:1 to about 1:1.

32. The method of claim 28 wherein the second solution includes ruthenium in an amount of from about 2 to about 10 milligrams per milliliter of solution and titanium in an amount of from about 20 to about 40 milligrams per milliliter of solution.

33. The method of claim 26 wherein the weight ratio of titanium to ruthenium in the second solution is from about 10:1 to about 2:1.

34. The method of claim 29 wherein the second solution includes ruthenium in an amount of from about 2 to about 10 milligrams per milliliter of solution and titanium in an amount of from about 20 to about 40 milligrams per milliliter of solution.

35. An electrode produced by the methods of claims 1 or 25.

36. An electrode produced by the method of claim 12.

37. An electrode produced by the method of claims 11 or 27.

38. An electrode produced by the method of claim 28.

39. An electrode produced by the method of claim 34.

* * * * *